United States Patent [19]

Sellers et al.

[11] 4,096,485

[45] Jun. 20, 1978

[54] SUCCESSIVE DEVELOPMENT MAGNETIC IMAGING APPARATUS

[75] Inventors: Edward C. Sellers, Buffalo; Chander Malkani, Tonawanda, both of N.Y.

[73] Assignee: Xerox Corporation, Stamford, Conn.

[21] Appl. No.: 735,474

[22] Filed: Oct. 26, 1976

Related U.S. Application Data

[62] Division of Ser. No. 537,230, Dec. 30, 1974.

[51] Int. Cl.[2] ..... G03G 19/00

[52] U.S. Cl. ..... 346/74.1; 118/657

[58] Field of Search ..... 360/17; 346/74.1; 118/657, 658

[56] References Cited

U.S. PATENT DOCUMENTS

| | | | |
|---|---|---|---|
| 3,161,544 | 12/1964 | Berry | 346/74.1 |
| 3,185,777 | 5/1965 | Rheinfrank | 346/74.1 |
| 3,707,608 | 12/1972 | Sugaya | 360/17 |
| 3,743,769 | 7/1973 | Yano et al. | 360/17 |
| 3,804,511 | 4/1974 | Rait et al. | 346/74.1 |
| 4,005,439 | 1/1977 | Levy | 346/74.1 |

*Primary Examiner*—Jay P. Lucas

*Attorney, Agent, or Firm*—James J. Ralabate; John E. Beck; George J. Cannon

[57] ABSTRACT

A magnetic imaging system is disclosed wherein an optical image is first reduced to a graphic image by employing a magnetizable marking material followed by magnetization of the graphic image and transfer of the imagewise pattern of magnetization to a magnetic substrate to provide a latent magnetic image. The latent magnetic image is utilized for the purpose of image duplicating by successive development and transfer steps or for electronic transmission of information. Improved latent magnetic images are provided by retoning the graphic image after magnetization and further magnetizing the retoned graphic image from which the latent image is produced. Also, polishing the redeveloped graphic image further improves the quality of the latent image.

8 Claims, 4 Drawing Figures

SUCCESSIVE DEVELOPMENT MAGNETIC IMAGING APPARATUS

This is a division of application Ser. No. 537,230, filed Dec. 30, 1974.

BACKGROUND OF THE INVENTION

This invention relates to magnetic imaging and more particularly to the creation of improved latent magnetic images on magnetic substrates.

There has recently been discovered a magnetic imaging system which employs a latent magnetic image on a magnetizable substrate which can then be utilized for purposes such as electronic transmission or in a duplicating process by repetitive toning and transfer of the developed image. Such latent magnetic image is provided by any suitable magnetization procedure whereby a magnetized layer of marking material is magnetized and such magnetism transferred imagewise to the magnetic substrate. Such a process is more fully described in U.S. Pat. No. 3,804,511 to Rait et al., which patent is hereby incorporated by reference.

As is disclosed in said patent, an optical image can be reproduced by first reducing it to a graphical image but employing a magnetizable marking material. Such magnetizable material is typically electroscopic toner comprising a ferromagnetic material which, after image formation is susceptible to magnetization. There is thus formed an imagewise pattern of magnetization which pattern is then transferred to a magnetic substrate by any one of several methods as disclosed in said patent. Preferably, the magnetization in imagewise pattern is produced in a magnetic substrate by the anhysteretic method whereby the magnetized graphic image is brought into intimate contact with a magnetic substrate and while in contact is subjected to an A.C. signal. The magnetic substrate is thereby magnetized in image configuration in accordance with the graphic image. Other methods of utilizing the magnetized graphic image for producing a latent magnetic image are also disclosed such as by providing intimate contact between the graphic magnetic image and a previously uniformly magnetized substrate and applying an erase signal through the graphic image support thereby applying the magnetic image as a shunt for the erase signal. There is thus produced by selective erasure in background areas a latent magnetic image in those areas shunted by the magnetic graphic image. Various other methods of providing such latent image utilizing a previously formed magnetizable graphic image are disclosed in the patent referred to above.

One desires to form a latent magnetic image having the highest possible degree of magnetization such that its detection by any of the several methods is facilitated. The process variations inevitable in prior art imaging systems whereby the magnetizable graphic image is produced causes variations in toner depth, unevenness of the surface of the image and background problems. Such variations make difficult the creation of high quality latent magnetic images by the method referred to above.

SUMMARY OF THE INVENTION

Therefore, an object of this invention is to provide a magnetic imaging method wherein the deficiencies of the prior art are overcome.

Another object of this invention is to provide the magnetic imaging method whereby magnetization for the purpose of creating a latent magnetic image is facilitated.

Another object of this invention is to provide latent magnetic images of improved quality.

These and other objects of this invention will be apparent from reading the following description of the invention.

In accordance with the present invention there is provided a method wherein superior latent magnetic images are produced by means of increasing the amount of magnetizable material in a magnetizable graphic image employed to magnetize a magnetic substrate in image configuration. Once having increased the amount of magnetic material in the graphic image further improved latent images are provided by the steps of polishing the image so as to smooth its surface. Such polishing provides more intimate contact between the magnetized graphic image and the magnetic substrate during the magnetization of the magnetic substrate.

DETAILED DESCRIPTION OF THE DRAWINGS

Figure 1:
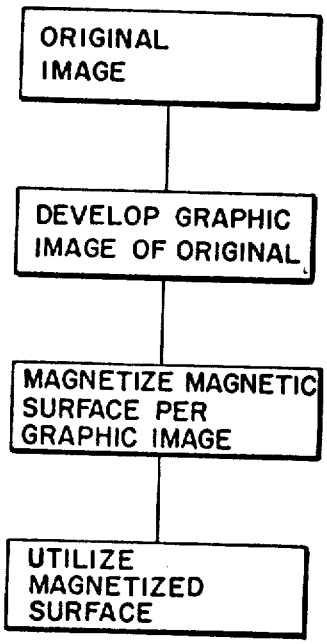
FIG. 1 is a flow chart of a prior art magnetic imaging method for creating latent magnetic images.

Referring now to FIG. 1 there is shown a flow chart of a magnetic imaging process such as is more fully described in U.S. Pat. No. 3,804,511, referred to above. An optical image, or, for example, any original document, is first copied or duplicated such as by typing, printing, or any one of the many electrophotographic means available for copying original documents. The only distinguishing feature required in accordance with this invention is that the marking means employed, for example, the ink in the printing or typing method or the electroscopic toner in the electrophotographic methods, must contain at least one magnetizable component. This is usually achieved by incorporating into the ink or toner or any other form of marking material very finely divided ferromagnetic material such as iron oxide or any of the other well known materials susceptible to magnetization. The developed graphic image, in accordance with the prior art, is then magnetized most conveniently by applying an A.C. signal to the developed image. After being magnetized, this image is employed in any one of several known means to impart an imagewise magnetization pattern in a magnetic substrate.

Several means for producing the latent image pattern in the magnetic substrate are known. For example, the magnetic substrate may be uniformly magnetized and selectively demagnetized by placing the magnetic image in intimate contact with the magnetized substrate and applying an erase signal through the back of the image support material thereby selectively erasing the magnetic substrate in areas not in contact with the image pattern. More preferably, the magnetic substrate is selectively magnetized by bringing the magnetized image into intimate contact with the substrate while under the influence of an A.C. field as will be further described below. The thus formed latent magnetic image is then utilized for any one of several purposes such as electronic transmission of the information contained in the latent image or for graphic duplication provided by repetitive toner development of the latent image and transfer of the developed image to a receiving substrate. Thus, there exists in the prior art methods for producing and utilizing latent magnetic images which require intimate contact between a magnetizable graphic image and a magnetic substrate for the purpose of forming a latent magnetic image.

Figure 2:
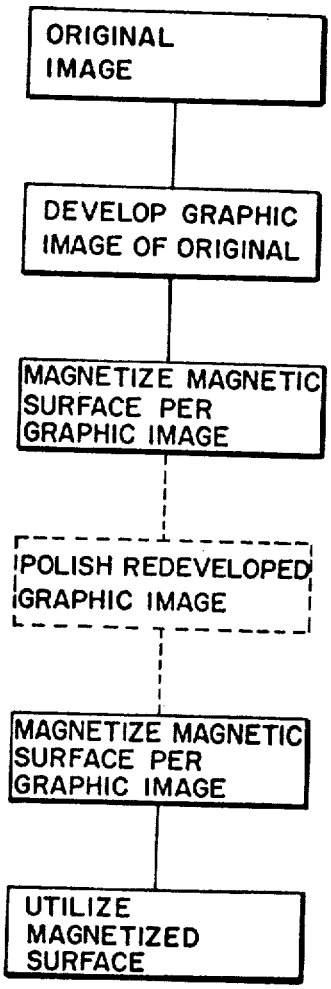
FIG. 2 is a flow chart of one method of this invention for providing latent magnetic images.

Referring now to FIG. 2 there is shown a flow chart of the process of this invention. As shown in FIG. 2 there is a common starting material consisting of an optical or an original image which is to be recorded or reduced to a graphic image by any of the prior art methods described above. As in the prior art, the image is developed with a material having a magnetizable component such that after development, the image can be magnetized. In accordance with this invention, it has been found to be highly beneficial to subject the magnetized image to a further development step which includes the application of additional marking material having a magnetic component included therein. Such material can be the same sort of developer that is employed for the production of the graphic image or a different magnetic material. Because the marking material includes a magnetically attractable material such material will adhere to the magnetized image and will not adhere to the background areas of the graphic image. There is thus produced a more dense image having a more magnetizable material than previously available. Upon magnetization of the redeveloped previously magnetized image a superior latent magnetic image is provided by utilizing such redeveloped image in the above described processes whereby intimate contact between the magnetized graphic image and the magnetic substrate is required.

By inserting an additional step in the process of this invention further improved latent magnetic images are obtained. That is, as shown by FIG. 2, in broken line, the redeveloped graphic image is subjected to a polishing step wherein a mildly abrasive material is contacted to the surface of the redeveloped graphic image and by polishing action the surface of the graphic image is smoothed. Of course, care must be taken so as to perform the polishing step evenly throughout the surface of the graphic image and also to prevent removal of excessive amounts of marking material during the polishing operation. Any suitable means for polishing the image surface can be employed in the process of this invention.

The polished image is now ready to be employed for the purpose of creating a latent magnetic image in a magnetic substrate by any one of the several known methods including the step of placing the magnetic substrate which is to bear the latent image into intimate contact with a magnetizable image. It has been found that the smoother and more dense images produced in accordance with the invention enables the production of improved latent magnetic images, particularly with respect to the amount magnetization achieved and resolution of the latent image. The increased amount of magnetization achieved in accordance with this invention provides greater holding power for magnetic marking material such that images of greater density and lower background are provided when the latent image is utilized as a duplicating master. Of course, images having greater magnetization as produced in accordance with the process of this invention are more easily transmitted electronically due to the greater ease with which the image is detected electronically by the transmitting apparatus.

Figure 3:
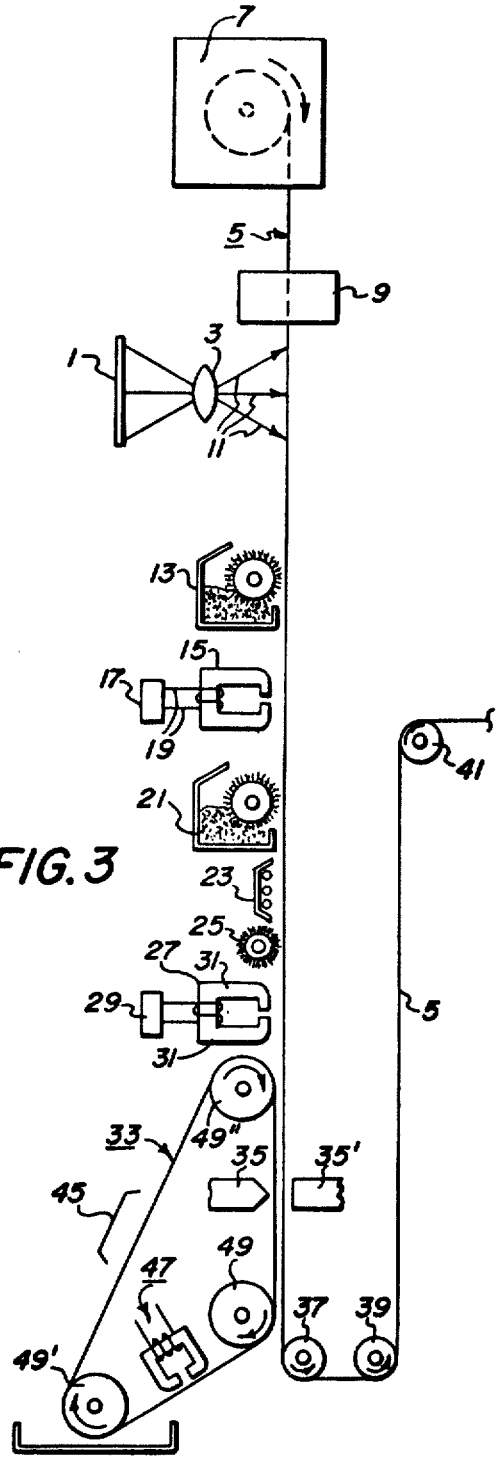
FIG. 3 is a diagrammatic view of one method of this invention including the xerographic procedure for producing a magnetizable graphic image.

The process of this invention is more fully described by the method and apparatus disclosed in FIG. 3. In FIG. 3 an optical image of an original document 1 is focused through lens 3 onto photoconductive medium 5. The photoconductive medium 5 is fed from supply roll 7 through charging means 9 to the imaging station in alignment with lens 3. Photoconductive medium 5 is typically a zinc oxide coated material having a conductive backing such that it will support an electrostatic image. The image is provided by the selective discharge of the medium by the exposure to light rays 11. Charging means 9 can be any suitable prior art means for imparting an electrostatic charge to the photoconductive surface of medium 5. Most preferably, a corona discharge device typically employed in the xerographic process is employed. Once an electrostatic latent image has been created on photoconductive surface 5 the medium is transported to a first developing station 13 wherein electroscopic toner containing both electrostatically attractive and magnetically attractive components, is applied to the latent image. Preferably, the electroscopic toner particles also contain a resinous component to facilitate fixing of the material to medium 5. One form of magnetic toner particles found to perform satisfactorily is available under the trade name Tribofax No. 213 electrostatic imaging material available from the Surface Processes Corp. of Pennsylvania. The means designated 13 for applying magnetic toner particles to medium 5 is representative of various toner applying arrangements known in the art and may be employed in the apparatus of the present invention.

After having developed the latent electrostatic image with magnetizable toner particles medium 5 carrying the developed image is brought into operative relationship with magnetic recording head 15. Alternatively, the toner image is first fixed to the photoconductive surface. For the purpose of magnetizing the toner image a suitable drive current is derived from power source 17 operatively associated with recording head 15 through wires 19. By means of applying the recording signal to the developed image the image becomes magnetized and thereby capable of receiving additional magnetically attractable toner particles. Typically, the recording signal has a pole to pole spacing in the range of 1.8 to about 7 mils, preferably from about 1.88 to about 3.75 mils with a current sufficient to provide saturation of the magnetic material, typically in the range of from about 70 to about 400 milliamps for commonly available materials. After having been magnetized the developed image on photoconductive medium 5 is then subjected to further development at developing station 21 which applied toner particles in similar fashion as developing station 13 with the exception that the attractive force is no longer electrostatic but rather magnetic. The addition toner applied at station 21 need not contain an electrostatically attractable component but can be complete magnetically attractable material. Thus, the magnetically attractable toner adheres to the magnetized image and can be removed from the background areas by means such as a flow of forced air (not shown). Subsequent to the second developing means the redeveloped image is then fixed to the substrate by a typically fusing apparatus generally designated 23. While any prior art method of fusing the image can be employed such methods are typically thermal and the fuser is usually a heating means which radiates heat to the toner particles which, as previously described, contain a resinous component which softens and attaches to the substrate. The additional toner supplied at station 21 need not contain a resinous component for purposes of fixing because the previous toner material may provide sufficient fixative material to hold the additional magnetic toner. The top surface of the image thereby presents a more concentrated amount of magnetic material to the magnetic substrate in a subsequent step of magnetization utilizing the magnetic image.

To further improve the quality of the latent image produced in accordance with this invention, a buffing means is incorporated into the apparatus as shown in FIG. 3 generally designated as 25. Buffer 25 can take the form of any buffing means such as a stiff bristled brush, an abrasively coated paper or cloth or steel wool affixed to the ruler component. Other means of buffing will occur to those of ordinary skill. Such buffing of the redeveloped image smooths the surface and if held at reasonable dimensional tolerances the thickness of the redeveloped image is normalized throughout the image such that when placed in contact with a magnetic substrate there will be a minimum of separation between the image and the substrate due to variations in thickness. Furthermore, greater surface area of the image is presented to the magnetic substrate eliminating the particulate nature of the marking material which existed prior to the buffing action.

After subjected the image to the buffing action, the image is prepared and utilized in a process whereby a latent magnetic image is produced. First, the buffed or polished image is subjected to the influence of a magnetic recording head 27 energized by power source 29 to apply an appropriate signal through pole pieces 31 and 31'. There is thus produced a magnetized image which is brought into contact with magnetic substrate 33 as they pass between pole pieces 35 and 35'. Pole pieces 35 and 35' are energized from a suitable power source, not shown, which applied an A.C. signal to the recording head thereby exciting the magnetic domains in each of the magnetized images residing on photoconductive substrate 5 and the magnetic material on magnetic substrate 33. In the embodiment shown, this treatment causes increased magnetization of the magnetic material residing on web 33 in the image configuration existing on photoconductive substrate 5. The graphic image thus provides the pattern for and is utilized in a method for creating a latent magnetic image through initmate contact with a magnetic substrate and is then retired from the system over rollers 37 and 39 and drive roller 41 to storage, not shown.

The thus provided latent magnetic image on magnetic substrate 33 can now be utilized as for example for producing successive copies of original image 1. This is accomplished by continuing the path of travel of the magnetic substrate 33 bearing a latent magnetic image thereon to developing station generally designated 43 for applying magnetic toner particles to magnetic substrate 33 in a manner such that the particles adhere in image configuration corresponding to the latent magnetic image thereon. The means employed for delivering the magnetic toner can be similar to that described herein above and can be any suitable prior art method. Provided the magnetic toner has an electrostatically attractive component, the developed image can then be transferred by electrostatic means similar to that employed in commercial xerography in the vicinity generally designated 45 to a transfer medium (not shown). If one only desires to view the image momentarily, the image can be erased by erase head 47 suitably energized by a power source (not shown) by continuing the rotating of magnetic substrate 33. Alternatively, the latent image can be electronically detected by known means at any suitable station in the circumference of the path of travel formed by magnetic surface 33 over rollers 49, 49' and 49''. A typical facsimile transmission system is described in U.S. Pat. No. 3,749,833 to Rait et al. which is hereby incorporated by reference. Rollers 49, 49' and 49'' can also be employed as drive means to propel magnetic surface 33 through the various processing stations required upon the application to which the latent magnetic image is directed.

Thus, there is provided in accordance with this invention an approved apparatus whereby images are duplicated or transmitted by means of suitable transducers which convert the latent magnetic image into electrical signal suitable for transmission to other apparatus.

Figure 4:
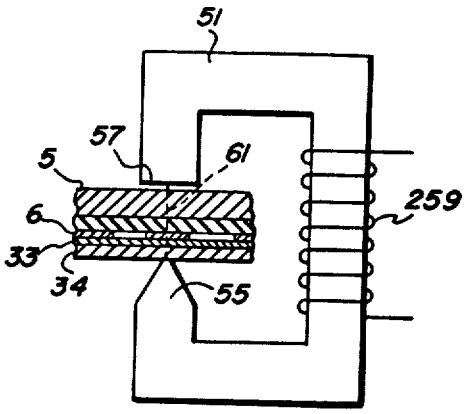
FIG. 4 is a diagrammatic view, partly in section, of one method of creating a latent magnetic image in accordance with the process of this invention.

To more particularly point out the features of this invention, there is shown in FIG. 4 magnetic record head 51 comprising one relatively sharp pole piece 55 and a relatively flat faced pole piece 57. There is wound around core 51 a coil 59 which is connected to a suitable source of energizing current (not shown). By means of an exaggerated drawing, FIG. 4 shows photoconductive substrate 5 bearing a developed image 6 which is in intimate contact with magnetic surface 33 residing on a substrate 34. Image 6 comprises magnetic toner particles as described above which have been deposited by a duplication of toner applications and preferably polished to an even surface. Prior to being brought into contact with surface 33, image 6 is magnetized. There is gained thereby a dense magnetic image which is capable of intimate contact with magnetic surface 33. While in such contact the various layers are caused to pass between pole pieces 55 and 57. For purposes of illustration, a single line of magnetic flux 61 is funneled through the areas of magnetized image 6 thereby magnetizing magnetic surface 33 in those areas. As can be seen in FIG. 4, intimate and uniform contact of the toner image 6 with magnetic surface 33 greatly aids in the establishment of flux lines between pole pieces 45 and 47. Furthermore, there is assured more uniform contact throughout all areas of toner image 6 with corresponding areas of magnetic surface 33 thereby producing a more uniform latent magnetic image and eliminating areas of reduced magnetization due to separation or poor contact of image 6 with surface 33. In addition, latent images produced in accordance with the method of this invention can achieve increased resolution.

An advantage gained by the process of this invention is the ability to provide more magnetic material on the surface of image 6 than was previously conveniently possible, particularly when employing the preferred electrostatic imaging method for the production of a magnetizable image. The initial application of toner can now contain an increased amount of resinous material for purposes of electrostatic attraction and fixing. The subsequent or second application of toner can then contain a high loading of magnetic material or could, in fact, be composed of completely magnetic material. The fixation of the completely magnetic material is achieved by embedment to some degree in the resinous material of the first toner applied. The magnetic attraction, in combination with the softening by any means such as vapor or heat, etc., of the first toner provides for such embedment as is required for fixing.

If more secure fixing is desired, for example, in order to provide more severe buffing action on the retoned image surface, a small amount of fixative material may be included with the second or subsequent toner material. Such fixative may take the form of a thin coating on the magnetic particles. Alternatively, finely divided fixative material can be dispersed throughout the magnetic toner and trapped within the image areas upon application of the toner to the magnetic image. In another embodiment a material which is reactive with the fixative material of the first toner applied can be included as a coating on or admixed in the second or subsequent toner particles. After application to the image the image is subjected to conditions whereby fixing is achieved by reaction of the materials separately applied. For example, a polymerizable material can be included with the first toner material applied to form the graphic image. A polymerization initiator is included in the material or applied to the image in the second or subsequent application of toner. The image is then subjected to conditions whereby the polymerizable material polymerizes thus providing a well fixed image capable of undergoing an intense buffing step. Suitable fixative materials include phenolic resins copolymerized mixtures of methacrylate esters and styrene, such as from 10–40 percent (by weight) of one or more methacrylate esters such as ethyl, propyl and butylmethacrylates as described in U.S. Pat. No. 3,079,742, gum copal, gum sandarac, rosin, asphaltum, pilsonite, rosin modified phenol formaldehyde resins, methacrylate resins, polyethylene resins, polypropylene resins, epoxy resins, polyethylene resins and mixtures thereof. Other patents which disclose materials useful in the toners of this invention, with respect to the fixative material are U.S. Pat. No. 2,659,670 to Coply; U.S. Pat. No. 2,754,408 to Landigan; U.S. Pat. No. 3,079,342 to Insalaco; U.S. Pat. No. 2,136 to Carlson; U.S. Pat. No. 2,788,288 to Rheinfrank et al. and U.S. Pat. No. 3,590,000 to Palermiti and Chatterji, all of which are hereby incorporated by reference.

Typical reactive materials useful as fixatives in the process of this invention are polymerizable materials. Typical polymerizable materials include ethylenically unsaturated compounds such as polyalkylene glycol diacrylates prepared from an alkylene glycol having 2 to 15 carbon atoms or a polyalkylene ether glycol of from 1 to 10 ether linkages, vinylidene compounds, the esters and amides of alpha-methylene carboxylic acids and substituted carboxylic with polyols and polyamines wherein the molecular chain between the hydroxyls and amino groups is solely carbon or oxygen-interrupted carbon. More specifically, polymerizable materials useful in this invention are ethylene diacrylate, diethylene glycol diacrylate, glycerol diacrylate, 1,3-propanediol dimethacrylate, 1,4-cyclohexanediol diacrylate, 1,4-benzenediol dimethacrylate, pentaerythritol tetramethacrylate, the bisacrylates and methacrylates of polyethylene glycols of molecular weight 200–500 and the like; unsaturated amides such as alphamethylene carboxylic acids, alpha, omega-diamines and oxygen interrupted omega-diamines, such as methylene bis-acrylamide, methylenebis-methlacrylamide, 1,6-hexamethylene bis-acrylamide, diethylene triamine tris-methylacrylamide and the like. Many other such compounds are described in the art such as in U.S. Pat. No. 3,060,024; 3,060,025 to Burg et al.; 3,060,026 to Heiart; 3,458,311 to Alles, and 3,615,480 to Lamb; all of the above patents being hereby incorporated by reference. Typical addition polymerization initiators are substituted and unsubstituted polynuclear quinones such as 9,10-anthraquinone, 1-chloroanthraquinone, octamethyl anthraquinone, 1,4-naphthoquinone, 9,10-pheneanthrenequinone, 2,3-dichloronephthalquinone, 1,4-dimethylanthraquinone, 2-phenylanthraquinone and the like. Other initiators include vicinal ketaldonyl compounds such as diacetyl benzil; alpha ketaldonyl alcohols such as benzoin, pivaloin; acyloin ethers such as benzoin methyl ethers and substituted aromatic acyloins including alpha-methyl benzoin, alpha-allylbenzoin and alpha-phenyalbenzoin.

In addition thermal polymerization inhibitors known in the art such as p-methoxyphenol is included for extended shelf life of the photopolymerizable materials.

The above mentioned photopolymerizable materials are usually contained in a vehicle such as a thermoplastic polymer having properties suitable for the intended use with respect to flexibility, thermostability and light stability. Typically suitable thermoplastics polymers include polyesters, copolyesters, polyamides, vinylidene chloride copolymers, ethylene/vinyl acetate copolymers, cellulose ethers, polyethylene, polyacrylate and alpha-alkyl polyacrylate esters, polyformaldehydes, polyurethanes, polycarbonates and polystyrenes.

Thus, the process of this invention allows many variations of materials to achieve a superior magnetic graphic image. Various fusing means can be employed other than heat as shown in FIG. 3. For example, fusing means 23 may take the form of a suitable source of actinic light whereby the fixative material reacts to fix the magnetic image.

In another embodiment of this invention one may find desirable the employment of a fusing step between the first and second application of toner material. Also, more than one additional application of toner may be desirable to further improve the magnetic image. Should one desire to retone the image 2 or more times additional magnetization is preferred after each addition of toner. Also, additional fixing steps between toner addition may be desirable.

Although specific components and proportions have been stated in the above description of preferred embodiments of the invention, other typical materials as listed above, if suitable may be used with similar results. In addition, other materials may be added to the mixture to synergize, enhance or otherwise modify the properties of the imaging layer. For example, various dyes, etc. may be added to the several layers.

Other modifications and ramifications of the present invention will occur to those skilled in the art upon a reading of the present disclosure. These are intended to be included within the scope of this invention.

What is claimed is:

1. An apparatus comprising a first image forming means whereby an optical image is converted by development with magnetically attractable material to a magnetizable graphic image, means to magnetize said graphic image, means to redevelop said magnetized graphic image with additional magnetically attractable material, means to magnetize said redeveloped image and means to produce a latent magnetic image on a magnetic substrate wherein said magnetized redeveloped image is brought into intimate contact with said magnetic substrate.

2. The apparatus of claim 1 further including means to polish said redeveloped image.

3. The apparatus of claim 2 further including means to apply an excitation field across said magnetized image and said magnetic surface while they are in intimate contact with each other.

4. The apparatus of claim 1 further including means to develop said latent magnetic image on said magnetic surface.

5. The apparatus of claim 4 further including means to transfer said developed image from said magnetic surface to another surface.

6. The apparatus of claim 1 further including erase means for erasing the latent magnetic image from said magnetic surface.

7. The apparatus of claim 1 further including means to magnetize uniformly said magnetic surface and erase means to selectively erase said magnetization in areas not contacted by said redeveloped image.

8. An apparatus comprising means to reduce an optical image to a graphic image xerographically including developing with magnetizable marking material, means to magnetize said graphic image, means to redevelop said magnetized graphic image with additional magnetically attractable marking material, means to fix said redeveloped image to a substrate, means to polish said fixed image, means to magnetize said polished image and means to bring said polished image into an intimate contact with a magnetic surface whereby said magnetic surface is selectively magnetized in those areas so contacted.

* * * * *